US010641157B2

(12) United States Patent
Lee

(10) Patent No.: US 10,641,157 B2
(45) Date of Patent: May 5, 2020

(54) THERMOSTAT AND COOLING SYSTEM HAVING THE SAME

(71) Applicants: HYUNDAI MOTOR COMPANY, Seoul (KR); KIA MOTORS CORPORATION, Seoul (KR)

(72) Inventor: Hyo Jo Lee, Suwon-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/193,378

(22) Filed: Nov. 16, 2018

(65) Prior Publication Data

US 2019/0383201 A1 Dec. 19, 2019

(30) Foreign Application Priority Data

Jun. 19, 2018 (KR) ..... 10-2018-0070268

(51) Int. Cl.
*F01P 7/16* (2006.01)
*F01P 5/10* (2006.01)
*F01P 7/14* (2006.01)

(52) U.S. Cl.
CPC ..... *F01P 7/16* (2013.01); *F01P 5/10* (2013.01); *F01P 2007/146* (2013.01); *F01P 2031/16* (2013.01)

(58) Field of Classification Search
CPC .... F01P 7/16; F01P 2007/146; F01P 2031/00; F01P 7/00; F01P 7/12; F16K 31/002; F16K 31/025
See application file for complete search history.

(56) References Cited

U.S. PATENT DOCUMENTS

| | | | | | |
|---|---|---|---|---|---|
| 4,883,225 | A * | 11/1989 | Kitchens | F01P 7/16 | 236/34.5 |
| 6,764,020 | B1 * | 7/2004 | Zhao | G05D 23/022 | 123/41.1 |
| 9,581,072 | B2 * | 2/2017 | Hutchins | F01P 7/16 | |
| 9,803,764 | B2 * | 10/2017 | Chang | F01P 7/14 | |
| 9,903,258 | B1 * | 2/2018 | Tillman | G05D 23/022 | |
| 2005/0268866 | A1 * | 12/2005 | Finkbeiner | F01P 7/16 | 123/41.1 |
| 2010/0095908 | A1 * | 4/2010 | Deivasigamani | F01P 7/16 | 123/41.1 |
| 2015/0144078 | A1 * | 5/2015 | Hutchins | F01P 7/165 | 123/41.1 |
| 2016/0258341 | A1 * | 9/2016 | Yoon | F01P 7/16 | |
| 2017/0089250 | A1 * | 3/2017 | Kanzaka | F01P 3/02 | |
| 2017/0276056 | A1 * | 9/2017 | Spenny | F01P 7/16 | |
| 2018/0030880 | A1 * | 2/2018 | Takizawa | F01P 7/16 | |

* cited by examiner

*Primary Examiner* — Long T Tran
(74) *Attorney, Agent, or Firm* — Morgan, Lewis & Bockius LLP

(57) ABSTRACT

A thermostat includes: a thermostat housing having an inlet and an outlet; an internal housing having a main valve hole and a fail-safe hole, wherein the internal housing is disposed within the thermostat housing and internal housing and has a main chamber communicating with the inlet of the thermostat housing; a wax housing disposed within the internal housing and having a first wax and a second wax; a first valve selectively opening or closing the main valve hole according to expansion or shrink of the first wax; and a second valve selectively opening or closing the fail-safe hole according to expansion or shrink of the second wax.

12 Claims, 5 Drawing Sheets

THERMOSTAT AND COOLING SYSTEM HAVING THE SAME

CROSS-REFERENCE TO RELATED APPLICATION

This application claims priority to and the benefit of Korean Patent Application No. 10-2018-0070268 filed in the Korean Intellectual Property Office on Jun. 19, 2018, the entire contents of which are incorporated herein by reference.

TECHNICAL FIELD

The present disclosure relates to a thermostat and cooling system provided with the same. More particularly, the present disclosure relates to a thermostat and a cooling system provided with the same which may realize a fail-safe function.

BACKGROUND

An engine exhausts heat energy while generating torque by combustion of fuel, and the coolant absorbs the heat energy while circulating through the engine, a heater, a radiator, and the like and discharges the absorbed heat energy to outside.

When a temperature of the coolant of the engine is low, viscosity of oil may increase to increase frictional force and fuel consumption, and a temperature of an exhaust gas may increase gradually to lengthen a time for a catalyst to be activated, which degrades quality of the exhaust gas. In addition, as a time required for a function of the heater to be normalized is increased, a driver may feel discomfort.

When the coolant temperature is excessively high, since knocking occurs, performance of the engine may deteriorate by adjusting ignition timing in order to suppress the knocking. In addition, when a temperature of lubricant is excessively high, a viscosity is lowered such that a lubrication performance may be deteriorated.

For sufficient cooling of an engine and heat exchange elements, a thermostat or a control valve for controlling coolant flows are provided.

When the thermostat or the control valve malfunctions so that a temperature of coolant is raised excessively, a fail-safe thermostat is opened for protecting and the engine and so on.

The above information disclosed in this Background section is only for enhancement of understanding of the background of the disclosure, and therefore, it may contain information that does not form the prior art that is already known in this country to a person of ordinary skill in the art.

SUMMARY

The present disclosure has been made in an effort to provide to a thermostat and a cooling system provided with the same which can realize a fail-safe function.

A thermostat according to an exemplary embodiment of the present disclosure may include: a thermostat housing having an inlet and an outlet; an internal housing having a main valve hole and a fail-safe hole, disposed within the thermostat housing and having a main chamber which communicates with the inlet; a wax housing disposed within the internal housing and having a first wax and a second wax; a first valve selectively opening or closing the main valve hole according to expansion or shrink of the first wax; and a second valve selectively opening or closing the fail-safe hole according to expansion or shrink of the second wax.

A coolant passage configured for coolant flowing through the fail-safe hole to flow out to the outlet may be formed between the thermostat housing and the internal housing.

The first valve may include a guide rod connecting the first wax and the thermostat housing, a first rod disposed within the guide rod and movable along longitudinal direction of the guide rod according to expansion or shrink of the first wax, a main disk connected with the first rod and selectively opening or closing the main valve hole and a first elastic member disposed between the main disk and the thermostat housing and elastically support the main disk.

The second valve may include a second rod movable according to expansion or shrink of the second wax, a fail-safe disk connected with the second rod and selectively opening or closing the fail-safe hole and a second elastic member disposed between the fail-safe disk and the thermostat housing and elastically supporting the fail-safe disk.

The first wax and the second wax may be different materials, and an operation temperature of the second wax may be higher than an operation temperature of the first wax.

The thermostat may further include an electric heater configured for selectively expanding the first wax.

A cooling system according to another exemplary embodiment of the present disclosure may include: a coolant pump supplying a coolant to an engine; an integrated thermal management valve receiving the coolant from the engine and distributing the coolant, wherein the integrated thermal management valve has a thermostat mounted thereto, a radiator connected with the integrated thermal management valve and the coolant pump; and a controller controlling operations of the integrated thermal management valve. The thermostat may include: a thermostat housing having an inlet and an outlet; an internal housing having a main valve hole and a fail-safe hole, disposed within the thermostat housing, and having a main chamber communicating with the inlet of the thermostat housing; a wax housing disposed within the internal housing and having a first wax and a second wax; a first valve selectively opening or closing the main valve hole according to expansion or shrink of the first wax; a second valve selectively opening or closing the fail-safe hole according to expansion or shrink of the second wax; and an electric heater configured to selectively expand the first wax.

The coolant pump may be a variable water pump capable of controlling discharging amount of coolant and the controller may control an operation of the variable water pump.

A coolant passage configured for coolant flowing through the fail-safe hole to flow out to the outlet may be formed between the thermostat housing and the internal housing.

The first valve may include a guide rod connecting the first wax and the thermostat housing, a first rod disposed within the guide rod and movable along longitudinal direction of the guide rod according to expansion or shrink of the first wax, a main disk connected with the first rod and selectively opening or closing the main valve hole and a first elastic member disposed between the main disk and the thermostat housing and elastically support the main disk.

The second valve may include a second rod movable according to expansion or shrink of the second wax, a fail-safe disk connected with the second rod and selectively opening or closing the fail-safe hole and a second elastic member disposed between the fail-safe disk and the thermostat housing and elastically supporting the fail-safe disk.

The first wax and the second wax may be different materials, and an operation temperature of the second wax may be higher than an operation temperature of the first wax.

The thermostat and the cooling system provided with the same which may realize a fail-safe function without an additional thermostat.

DETAILED DESCRIPTION OF THE EMBODIMENTS

Figure 1:
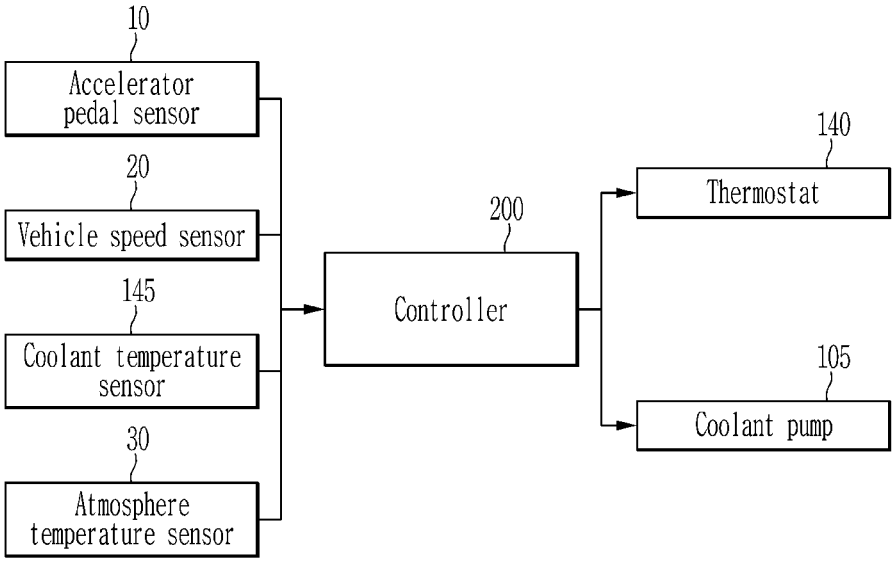
FIG. 1 is a block diagram of a cooling system according to an exemplary embodiment of the present disclosure.

Hereinafter, exemplary embodiments of the present disclosure will be described with reference to the accompanying drawings.

The sizes and thicknesses of the configurations shown in the drawings are provided selectively for the convenience of description, such that the present disclosure is not limited to those shown in the drawings and the thicknesses are exaggerated to make some parts and regions clear.

However, parts irrelevant to the description will be omitted to clearly describe the exemplary embodiments of the present disclosure, and the same or similar constituent elements will be designated by the same reference numerals throughout the specification.

In the following description, names of constituent elements are classified as a first . . . , a second . . . , and the like so as to discriminate the constituent elements having the same name, and the names are not necessarily limited to the order.

Figure 2:
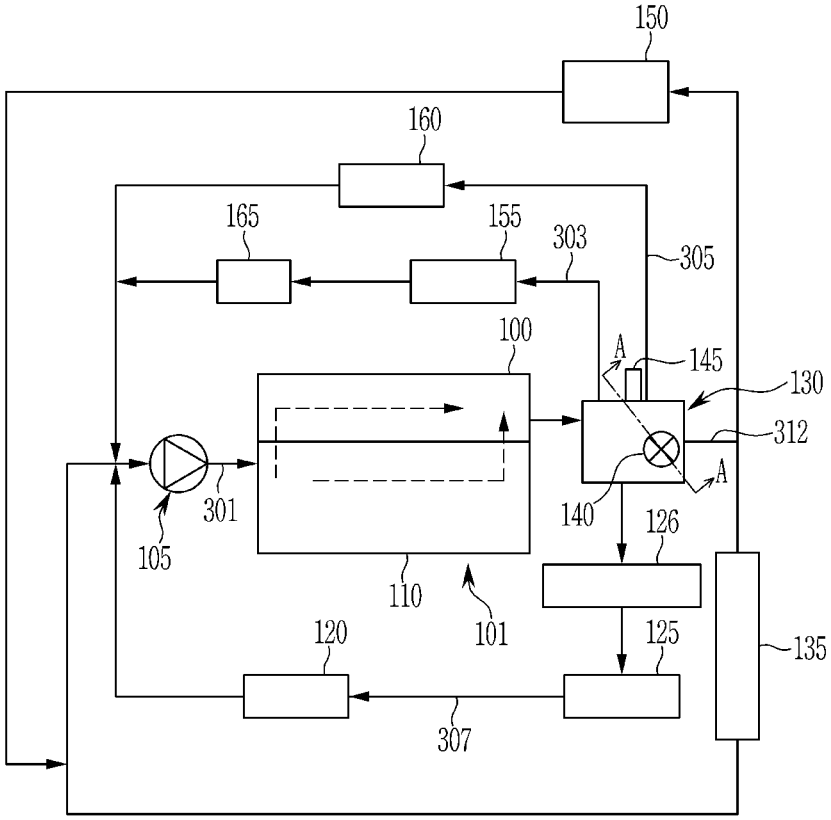
FIG. 2 is a schematic diagram of a cooling system according to an exemplary embodiment of the present disclosure.

FIG. 1 is a block diagram of a cooling system according to an exemplary embodiment of the present disclosure, and FIG. 2 is a schematic diagram of a cooling system according to an exemplary embodiment of the present disclosure.

Referring to FIG. 1 and FIG. 2, a cooling system according to an exemplary embodiment of the present disclosure includes an engine 101 provided with a cylinder block 110 and a cylinder head 100, a coolant pump 105, an integrated thermal management valve 130, a radiator 135 and a plurality of heat exchange elements.

The coolant pump 105 is disposed to an inlet side of the engine 101 and the integrated thermal management valve 130 is disposed to an outlet side of the engine 101.

The coolant pump 105 is connected with the cylinder block 110, the cylinder head 100 is connected with the integrated thermal management valve 130 and coolant flows from the coolant pump 105, the cylinder block 110, the cylinder head 100 and the integrated thermal management valve 130 sequentially. However, it is not limited thereto. That is, the coolant pump 105 may be connected to the cylinder block 110 and the cylinder head 100 to transmit coolant simultaneously and then the coolant may flow to the integrated thermal management valve 130.

The cooling system according to an exemplary embodiment of the present disclosure may further include a vehicle operation state detecting portion, and a controller 200 controls operations of the coolant pump 105 and the integrated thermal management valve 130 according to output signals of the vehicle operation state detecting portion.

The vehicle operation state detecting portion includes, for example, an accelerator pedal sensor 10, a vehicle speed sensor 20, a coolant temperature sensor 145, and an atmosphere temperature sensor 30.

For example, the heat exchange element may include a low pressure exhaust gas recirculation (LP EGR) cooler 155, a heater 165, an EGR valve 160, a reservoir tank 150, an oil cooler 125, a high pressure exhaust gas recirculation (HP EGR) cooler 120, an oil cooler 124, an automatic transmission fluid (ATF) warmer 126 and so on.

A plurality of coolant lines are provided for connecting the cylinder block 110, the cylinder head 100, the radiator 135, the plurality of heat exchange elements and the coolant pump 105.

For example, the plurality of coolant lines include an engine coolant line 301 transmitting coolant to the engine 101, a radiator coolant line 312 transmitting coolant to the radiator 135 and assist coolant lines 303, 305, and 307 transmitting coolant to the plurality of heat exchange elements.

The integrated thermal management valve 130 may control coolant flows from the cylinder block 110 and the cylinder head 100 to the radiator 135 and the plurality of heat exchange elements. The integrated thermal management valve 130 may be mechanical or electrical devices configured for controlling coolant flows.

The reservoir tank 150 is connected with the radiator coolant line 312 connected with the radiator 135 and coolant flowing through the reservoir tank 150 flows into the coolant pump 105.

The coolant temperature sensor 145 is configured for detecting a temperature of coolant flowing through the integrated thermal management valve 130. Additional coolant temperature sensor may be disposed for detecting a temperature of coolant flowing through the cylinder block 110.

A distribution scheme of the integrated thermal management valve 130 as shown in FIG. 2 is not limited thereto. On the contrary, numerous variations may be possible. The operations and functions of the heat exchange elements are obvious to a person skilled in the art, thus, detailed description will be omitted.

The coolant pump 105 receiving coolant transmitted from the heat exchange elements and radiator, and then pumps the coolant.

Figure 3:
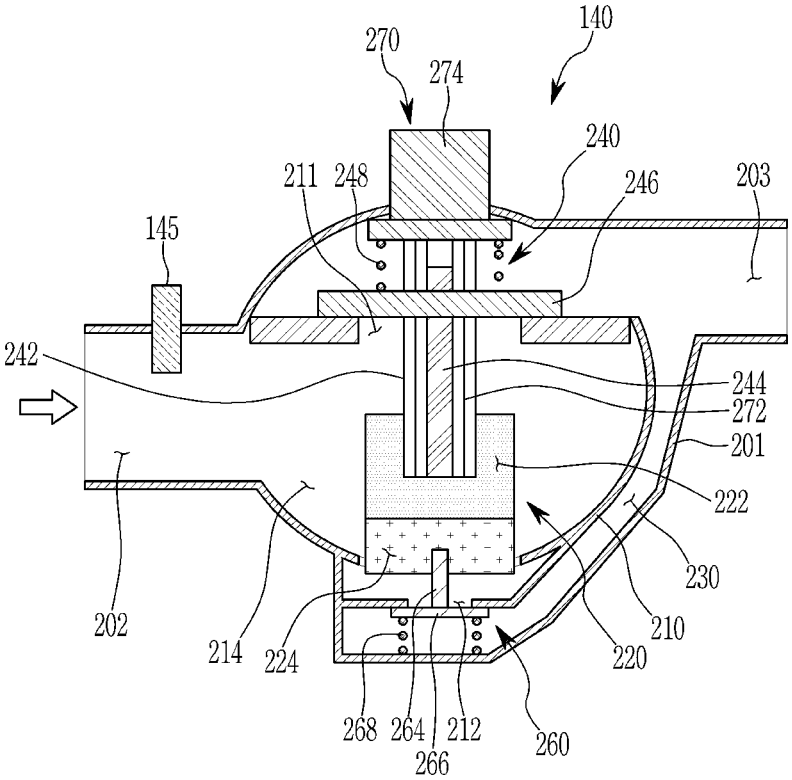
FIG. 3 to FIG. 5 are cross-sectional views along line A-A of FIG. 1.
Figure 4:
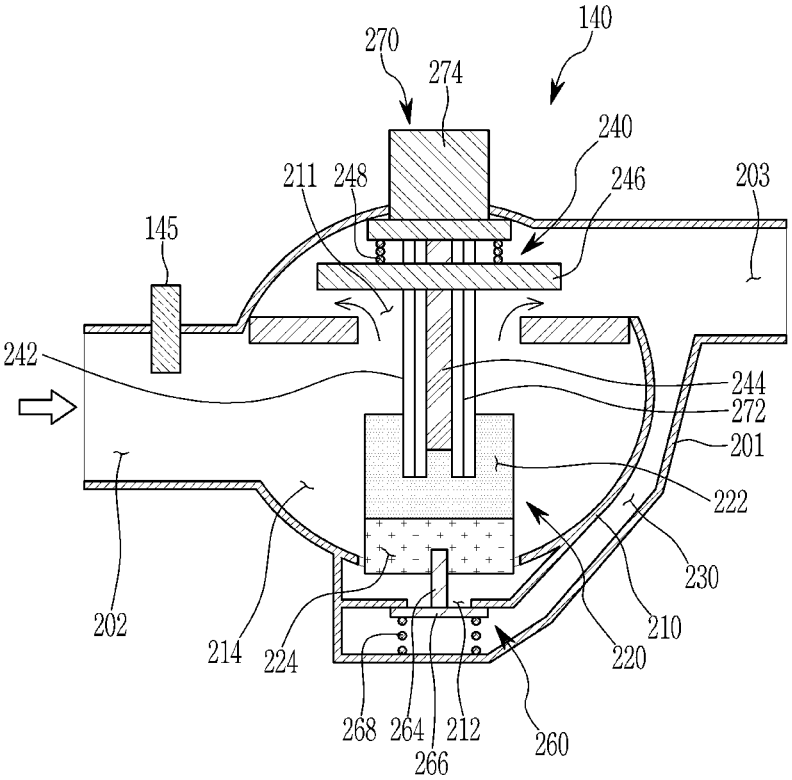
Figure 5:
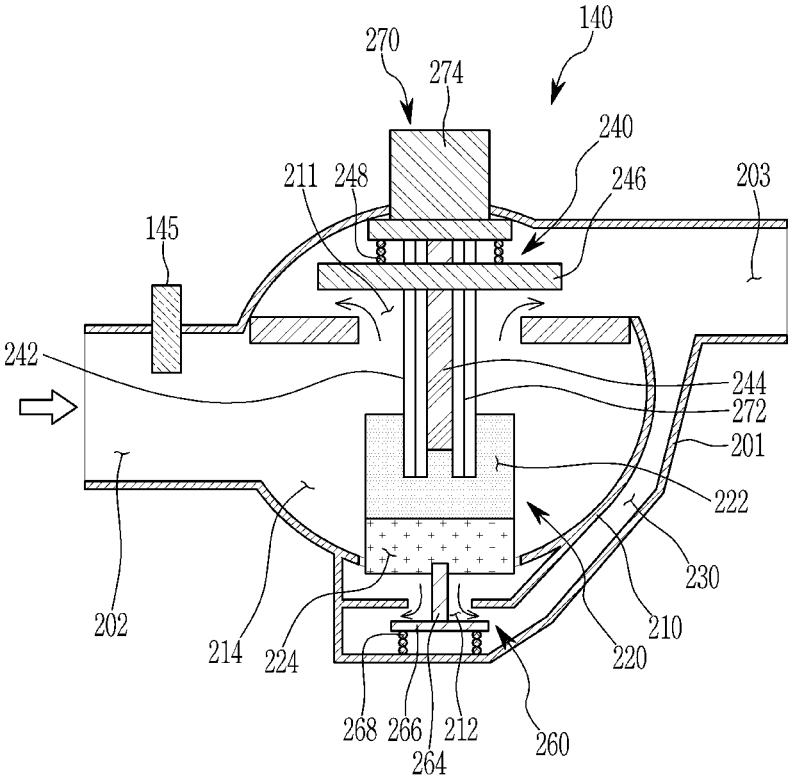

FIG. 3 to FIG. 5 are cross-sectional views along line A-A of FIG. 1.

Referring to FIG. 1 to FIG. 5, a thermostat 140 according to an exemplary embodiment of the present disclosure is mounted to the integrated thermal management valve 130. For example thermostat 140 may be mounted to a portion where coolant flows out to the radiator 135.

A thermostat 140 according to an exemplary embodiment of the present disclosure includes a thermostat housing 201 on which an inlet 202 and an outlet 203 are formed, an internal housing 210 on which a main valve hole 211 and a fail-safe hole 212 are formed, disposed within the thermostat housing 201 and internal housing 210 defining a main chamber 214 communicated with the inlet 202, a wax housing 220 mounted within the internal housing 210 and in which a first wax 222 and a second wax 224 are filled with, a first valve 240 selectively opening or closing the main valve hole 211 according to expansion or shrink of the first wax 222 and a second valve 260 selectively opening or closing the fail-safe hole 212 according to expansion or shrink of the second wax 224.

The thermostat 140 may transmit coolant supplied from the engine coolant line 301 to the radiator coolant line 312 according to control of the controller 200. The thermostat 140 may transmit the coolant to the assist coolant lines 303, 305, and 307.

For easy comprehension, the thermostat 140 according to an exemplary embodiment of the present disclosure will be described such as a device for controlling a coolant flow to the radiator coolant line 312, however, it is not limited thereto. The thermostat 140 may be applied to various schemes to control flows to a plurality of coolant lines.

A coolant passage 230 configured for coolant flowing through the fail-safe hole 212 to flow out to the outlet 203 is formed between the thermostat housing 201 and the internal housing 210. Since the coolant passage 230 is formed between the thermostat housing 201 and the internal housing 210, so that the coolant passage 230 may be easily manufactured and coolant exhaust may be fluently performed through the coolant passage 230.

The first valve 240 includes a guide rod 242 connecting the first wax 222 and the thermostat housing 201, a first rod 244 disposed within the guide rod 242 and movable along longitudinal direction of the guide rod 242 according to expansion or shrink of the first wax 222, a main disk 246 connected with the first rod 244 and selectively opening or closing the main valve hole 211 and a first elastic member 248 disposed between the main disk 246 and the thermostat housing 201 and elastically support the main disk 246.

The second opening device 260 includes a second rod 264 movable according to expansion or shrink of the second wax 224, a fail-safe disk 266 connected with the second rod 264 and selectively opening or closing the fail-safe hole 212 and a second elastic member 268 disposed between the fail-safe disk 266 and the thermostat housing 201 and elastically supporting the fail-safe disk 266.

The first and second elastic members 248 and 268 are elements supplying elastic force for the main disk 246 and the fail-safe disk 266 to close the main valve hole 211 and the fail-safe hole 212 respectively, and may be various elastic members such as a coil spring.

The first wax 222 and the second wax 224 are different materials, and an operation temperature of the second wax 224 is higher than an operation temperature of the first wax 22.

The thermostat 140 according to an exemplary embodiment of the present disclosure may further include an electric heater 272, connected to the guide rod 242, configured for selectively expanding the first wax 222.

That is, the thermostat 140 may be an electric thermostat. The thermostat 140 includes a heating portion 270, which includes a heater connector 274 electrically connected with an electric power and the electric heater 272 electrically connected with the heater connector 274. The controller 200 may control an operation of the electric heater 272.

The coolant pump 105 may be a variable water pump which may control discharging amount of coolant. The controller 200 may control an operation of the variable water pump 105.

That is, the controller 200 may control the operations of the variable water pump 105 and thermostat 140 according to output signals of the vehicle operation state detecting portion.

Hereinafter, referring to FIG. 1 to FIG. 5, operations of the cooling system according to the exemplary embodiment of the present disclosure will be discussed.

The controller 200 controls the operations of the variable water pump 105 and the electrical thermostat 140 according to the corresponding signals of the vehicle operation state detecting portion including the accelerator pedal sensor 10, the vehicle speed sensor 20, the coolant temperature sensor 145 and the atmosphere temperature sensor 30.

In a predetermined cool diving condition, for example, the predetermined cold driving condition may be preset as the output signal of the coolant temperature sensor 145 is less than 50° C., and the controller 200 may control the variable water pump 105 not to discharge the coolant. In this case, entire flowing of the coolant stops and warm-up timing of the engine may be decreased.

In a predetermined warm diving condition, for example, the predetermined warm driving condition may be preset as the output signal of the coolant temperature sensor 145 is between 50° C. and 90° C. and the controller 200 may control the variable water pump 105 to discharge the coolant as preset amount. In this case, the electrical thermostat 140 does not work, so that the coolant does not flow through the radiator 135.

That is, as shown in FIG. 3, in predetermined cooling driving condition and the predetermined warm driving condition, the electrical thermostat 140 does not work.

In a predetermined high temperature driving condition, for example, the predetermined warm driving condition may be preset as the output signal of the coolant temperature sensor 145 is between 90° C. and 105° C., the controller 200 controls the operations of the variable water pump 105 and the electrical thermostat 140 for the coolant temperature to be maintained between 90° C. and 105° C.

That is, as shown in FIG. 4, heat of the coolant flowed in the main chamber 214 may be transmitted to the first wax 222 so as to be expanded or the controller 200 operates the heating portion 270 for the first wax 222 to be expanded. Then, the first rod 244 and the main disk 246 moves so as that the main valve hole 211 is opened.

If the coolant temperature is raised in spite of the operation of the heating portion 270, as shown in FIG. 5, the heat of the coolant flowed in the main chamber 214 may be transmitted to the second wax 224 so as to expand.

Then, the second rod 264 and the fail-safe disk 266 moves so as that the fail-safe hole 212 is open.

For example, the material of the second wax 224 may be selected to be operated when coolant temperature reaches to about 105° C. so as to protect the engine and the cooling system.

The selection of material for the second wax 224 may be obvious to a person skilled in the art, and thus, detailed description will be omitted.

The thermostat and the cooling system provided with the same according to the exemplary embodiment of the present disclosure may realize a fail-safe function without additional fail-safe thermostat.

According to the thermostat and the cooling system provided with the same according to the exemplary embodiment of the present disclosure, a scheme of the cooling system may be simplified and a layout of the total system also may be simplified.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A thermostat comprising:

a thermostat housing having an inlet and an outlet;

an internal housing having a main valve hole and a fail-safe hole, wherein the internal housing is disposed within the thermostat housing and has a main chamber, which communicates with the inlet of the thermostat housing, inside the internal housing;

a wax housing disposed inside the internal housing and having a first wax and a second wax;

a first valve selectively opening or closing the main valve hole according to expansion or shrink of the first wax;

a second valve selectively opening or closing the fail-safe hole according to expansion or shrink of the second wax; and a coolant passage, through which coolant flowing through the fail-safe hole flows out to the outlet of the thermostat housing, defined between the thermostat housing and the internal housing.

2. The thermostat of claim 1, wherein the first valve comprises:

a guide rod connecting the first wax and the thermostat housing;

a first rod disposed within the guide rod and configured to be movable in a longitudinal direction of the guide rod according to the expansion or shrink of the first wax;

a main disk connected with the first rod and selectively opening or closing the main valve hole; and a first elastic member disposed between the main disk and the thermostat housing to elastically support the main disk.

3. The cooling system of claim 2, wherein the first elastic member includes a coil spring.

4. The thermostat of claim 1, wherein the second valve comprises:

a second rod configured to be movable according to expansion or shrink of the second wax;

a fail-safe disk connected with the second rod and selectively opening or closing the fail-safe hole; and a second elastic member disposed between the fail-safe disk and the thermostat housing elastically support the fail-safe disk.

5. The cooling system of claim 4, wherein the second elastic member includes a coil spring.

6. The thermostat of claim 1, wherein the first wax and the second wax have respective materials different from each other, and wherein an operation temperature of the second wax is higher than an operation temperature of the first wax.

7. The thermostat of claim 1, further comprising an electric heater configured to selectively expand the first wax.

8. A cooling system comprising:

a coolant pump supplying a coolant to an engine;

an integrated thermal management valve receiving the coolant from the engine and distributing the coolant, wherein the integrated thermal management valve has a thermostat mounted thereto;

a radiator connected with the integrated thermal management valve and the coolant pump;

a controller controlling operations of the integrated thermal management valve, wherein the thermostat comprises:

a thermostat housing having an inlet and an outlet;

an internal housing having a main valve hole and a fail-safe hole, wherein the internal housing is disposed within the thermostat housing and has a main chamber, which communicates with the inlet of the thermostat housing, therein;

a wax housing disposed within the internal housing and having a first wax and a second wax;

a first valve selectively opening or closing the main valve hole according to expansion or shrink of the first wax;

a second valve selectively opening or closing the fail-safe hole according to expansion or shrink of the second wax;

an electric heater configured to selectively expand the first wax; and a coolant passage, through which coolant flowing through the fail-safe hole flows out to the outlet of the thermostat housing, defined between the thermostat housing and the internal housing.

9. The cooling system of claim 8, wherein the coolant pump is a variable water pump configured to control a discharging amount of the coolant, and wherein the controller controls an operation of the coolant pump.

10. The cooling system of claim 8, wherein the first valve comprises:

a guide rod connecting the first wax and the thermostat housing;

a first rod disposed within the guide rod and configured to be movable in a longitudinal direction of the guide rod according to the expansion or shrink of the first wax;

a main disk connected with the first rod and selectively opening or closing the main valve hole; and a first elastic member disposed between the main disk and the thermostat housing to elastically support the main disk.

11. The cooling system of claim 8, wherein the second valve comprises:

a second rod configured to be movable according to the expansion or shrink of the second wax;

a fail-safe disk connected with the second rod and selectively opening or closing the fail-safe hole;

a second elastic member disposed between the fail-safe disk and the thermostat housing to elastically support the fail-safe disk.

12. The cooling system of claim 8, wherein the first wax and the second wax have materials different from each other, and wherein an operation temperature of the second wax is higher than an operation temperature of the first wax.

* * * * *